United States Patent [19]

Slavik et al.

[11] 4,022,389

[45] May 10, 1977

[54] PROCESS AND APPARATUS FOR AUTOMATICALLY FORMING A YARN RESERVE ON A WIND-UP BOBBIN

[75] Inventors: Valter Slavik, Horgen; Hieronimus Ghirlánda, Wattmil; Helmut Ritter, Wattmil; Arthur Dürr, Wattmil, all of Switzerland

[73] Assignee: Heberlein & Co. AG, Wattwil, Switzerland

[22] Filed: July 9, 1975

[21] Appl. No.: 594,448

[30] Foreign Application Priority Data

Aug. 16, 1974 Switzerland ..... 11217/74
May 7, 1975 Switzerland ..... 5874/75

[52] U.S. Cl. ..... 242/18 PW
[51] Int. Cl.[2] ..... B65H 54/34
[58] Field of Search ..... 242/18 PW, 18 A

[56] References Cited

UNITED STATES PATENTS

| | | | |
|---|---|---|---|
| 3,345,003 | 10/1967 | Mattingly et al. | 242/18 A |
| 3,730,447 | 5/1973 | Franzen et al. | 242/18 PW |
| 3,899,140 | 8/1975 | Gleyze | 242/18 PW |

*Primary Examiner*—Stanley N. Gilbreath
*Attorney, Agent, or Firm*—Larson, Taylor and Hinds

[57] ABSTRACT

Apparatus for automatically forming a yarn reserve on a wind-up bobbin of a yarn treatment machine, is described in which a slot disc at one end of the bobbin pinches and tears off the yarn prior to causing the yarn to engage a first stationary catching thread guide through which the yarn passes while being wound to form the yarn reserve. However, as the usual reciprocating thread-guide approaches the end of the bobbin, a movable thread-guide element fixed thereto transfers the yarn to a second stationary catching thread-guide. Then, on reversal, the movable-thread-guide element releases the yarn, the second catching thread-guide being positioned so that the yarn then enters the reciprocating thread guide to enable the yarn to be wound up to fill the bobbin in the wind-up range thereof. To prevent the operator from damaging his fingers when inserting the yarn in the slot disc or when removing a full bobbin, the second catching thread-guide, on which the first catching thread-guide is fixed, may be pivotally mounted and held against an abutment by a spring. This catching thread-guide may then either be arranged to yield when touched or alternatively arranged so as to be manually brought to its operating position against spring reaction.

10 Claims, 7 Drawing Figures

FIG. 2
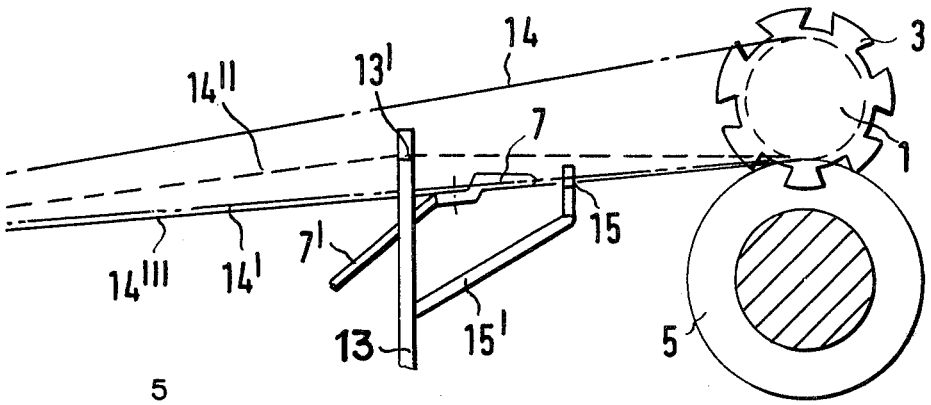
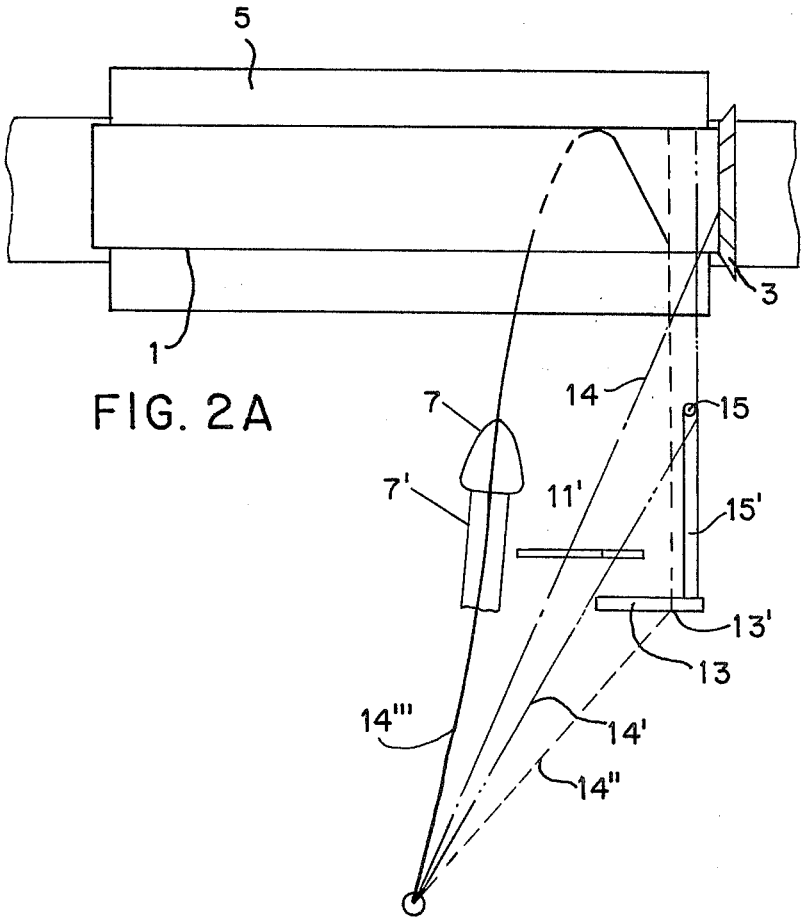
FIG. 2A

PROCESS AND APPARATUS FOR AUTOMATICALLY FORMING A YARN RESERVE ON A WIND-UP BOBBIN

BACKGROUND OF THE INVENTION

The present invention relates to an apparatus for automatically forming a yarn reserve on the wind-up bobbin of a yarn treatment machine to which the yarn is fed continuously.

DESCRIPTION OF THE PRIOR ART

In known wind-up and ply-twist machines, the application of the yarn onto the wind-up bobbin is effected partially by hand by pinching the yarn on one side of the wind-up bobbin and by allowing the wind-up bobbin to effect several rotations. Only after formation of this yarn reserve, the yarn is inserted into the reciprocating thread-guide.

It has been attempted to automate the formation of the yarn reserve. Thus, for example, a device is known in which, on the frame, there is disposed a thread-guide plate comprising a longitudinal slot open on one side, the slot edges being provided with meshing saw-tooth-like projections, the gaps between which correspond to saw-teeth on the other edge. The slot extends in parallel with the bobbin axis. On the reciprocating thread-guide, there is provided at least one wire loop pointing towards the thread-guide plate in the direction of reciprocation of the thread-guide, the loop being arranged so that the loop passes below the yarn at the point of reversal of the reciprocating movement of the thread-guide, lifts the yarn and puts it into the next identation between two projections towards the center until the yarn leaves the slot of the thread-guide plate and is seized by the reciprocating thread-guide.

SUMMARY OF THE INVENTION

The disadvantage of this known device however consists in that the application of the yarn is rendered difficult if the yarn is fed continuously and in that it is rather expensive. The purpose of the present invention is to avoid these disadvantages and to provide an apparatus for forming a thread reserve on a wind-up bobbin which is of simple construction and easy to operate.

According to the present invention, the running yarn which is aspirated by a suction device is at first moved away in the usual manner on one side of the wind-up bobbin by means of a slot-disc, pinched and torn off from the length of yarn leading to the suction device. The yarn pinched in the slot-disc is then inserted into a stationary catching thread-guide and thereby kept in a laterial position between the wind-up range and the end of the wind-up bobbin, whereby the formation of the yarn reserve is started. The yarn is then lifted by means of a thread-guide element movable together with the reciprocating thread-guide, when the thread-guide element approaches the reversing position of its movement at one end of the stroke of the thread-guide and the yarn is thereby inserted into the catching groove of a second stationary thread-guide element. After reversing at the said end of the stroke, the movable thread-guide element immediately passes under the yarn, lifts the yarn, removes it from the catching groove of the second stationary thread-guide element and inserts it into the reciprocating thread-guide.

The device suitable for effecting the process of the present invention, comprises a wind-up bobbin supported in a bobbin carrier with a slot disc disposed on one end of the bobbin and a reciprocating thread-guide, is characterized by a stationary catching thread-guide disposed between the wind-up range on the bobbin and the end of the wind-up bobbin, and by a plate-shaped part with a catching groove constituting the second stationary yarn guiding element.

During the start, i.e., when the wind-up bobbin is moved downwards onto the wind-up roller, the yarn is inserted by hand into the slot groove whereupon it is seized, pinched and torn off from the length of yarn leading to the suction device. Since the stationary plate-shaped thread-guide element must be disposed within the range of the slot disc for functional reasons, there is a certain danger of the operator of the machine hurting himself on this thread-guide element when inserting the yarn into the slot disc or when removing the full bobbins.

It is the purpose of a modified embodiment of the device according to the present invention to avoid the above-mentioned disadvantage.

This modification is characterized in that the second stationary thread-guide element comprises a part which can be swung around a pivot. This part comprises the catching groove which is kept in a stationary position by a spring coacting with an abutment. This stationary thread-guide element may preferably be shaped so that said pivoted part is kept in the stationary position in operation and can be temporarily swung out of the operation position. Alternatively, the stationary thread-guide element can be shaped so that the pivoted part is kept in the stationary position when not in operation and can temporarily be swung up into the operative position when required.

DESCRIPTION OF THE DRAWINGS

In order that the invention may be clearly understood and readily carried into effect apparatus in accordance therewith will now be described by way of example with reference to the accompanying drawings, in which:

FIG. 2 shows a part of the device of FIG. 1 in lateral elevation;

FIG. 2A shows a part of the device of FIG. 1 in plan view;

As shown in FIGS. 1, 2 and 2A, a wind-up bobbin 1 is supported in lateral limbs 2, 2' of a bobbin support between two bobbin plates 3, 3'. The bobbin plate 3 has the shape of a slot disc. The wind-up bobbin 1 is in contact with a drive roller 5. On a bearing block 6, there is fixed by means of screw 6' a support 7' of a reciprocating thread-guide 7. The bearing block 6 itself is fixed to a reciprocating rod 8. On the free end 7'' of the thread-guide support 7', there is provided a groove block 9 which slides along a guide rail 10.

Figure 1:
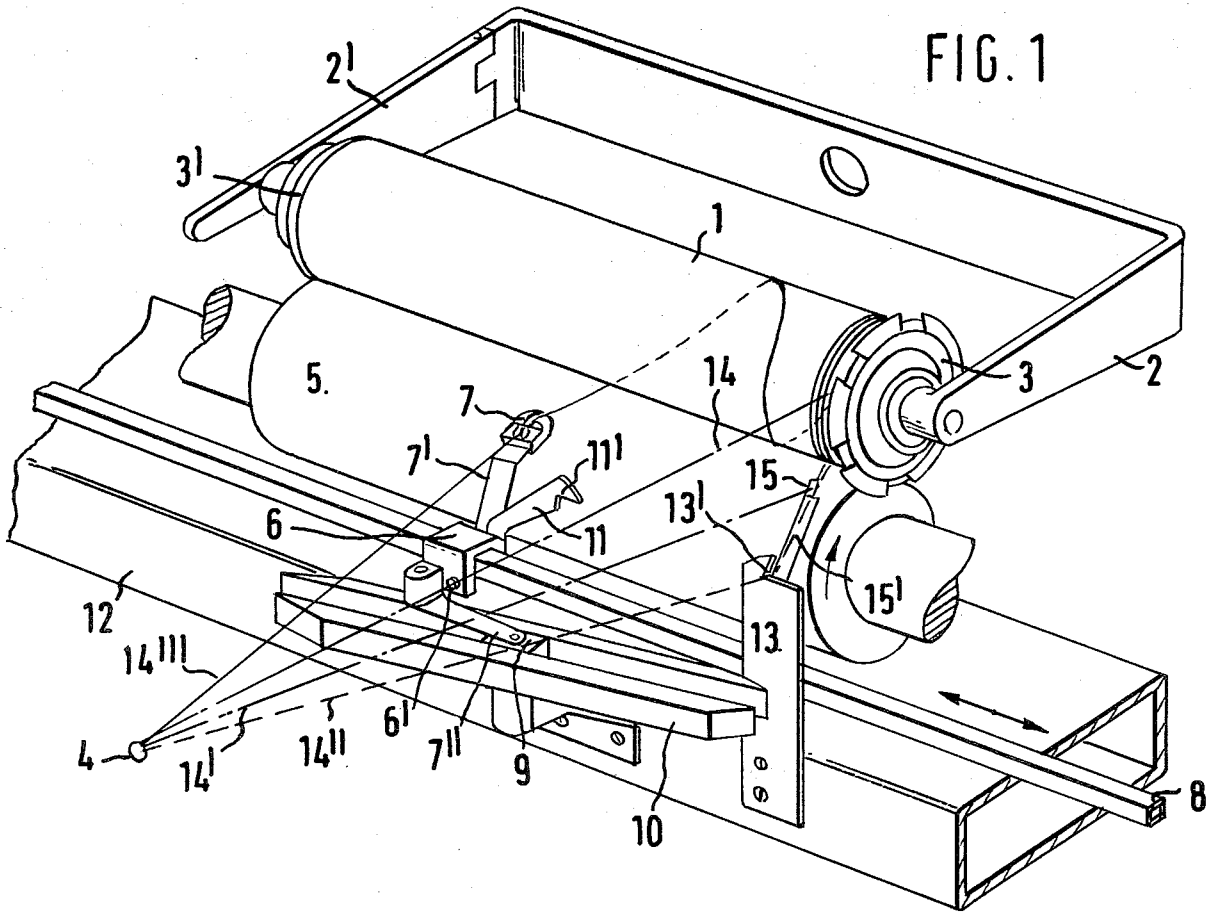
FIG. 1 shows schematically and in perspective view a device for automatically forming a yarn-reserve on a wind-up bobbin.

On the bearing block 6, there is furthermore fixed a movable thread-guide element in the form of a plate-shaped part 11 with a nose 11'. On a bobbin support rod 12, a further plate-shaped part 13 is fixed by means of screws, which is formed with a catching groove 13'. A support 15' with a first catching thread-guide 15 is fixed to the plate-shaped part 13 whereon the catching groove 13' constitutes a second catching thread-guide.

When starting, i.e., when lowering the wind-up bobbin 1 onto the drive roller 5, yarn 14 which is aspirated by a suction device (not shown) is continuously fed via a thread-guide 4 and inserted by hand into a slot groove in the bobbin plate 3 whereby, as the bobbin rotates, the yarn is engaged, pinched and torn off the length of yarn leading to the suction device. The yarn 14 pinched in slot groove is now automatically inserted into catching thread-guide 15 by the rotation of the bobbin plate 3 so that the yarn assumes position 14'. The yarn accordingly is in a lateral position between the end of the wind-up bobbin 1 in contact with bobbin plate 3 and the wind-up range of wind-up bobbin 1. In this intervening position the yarn reserve is now formed as a result of the rotating bobbin drawing the yarn through the thread-guide 15.

As soon as the reciprocating thread-guide 7 shown in FIG. 1 approaches its right hand reversal position, the lower edge of nose 11' shifts the yarn 14 into catching groove 13' so that it now assumes path 14'' which is somewhat higher than path 14' and which forms a bend in the path of the yarn passing to the bobbin 1. As soon as the reciprocating thread-guide 7 has passed its right reversal position, the nose 11' returns under the yarn in position 14'' and lifts the yarn, removing it from catching groove 13' so that the yarn straightens and snaps into thread-guide 7 so that the yarn now assumes position 14'''.

Now begins the real wind-up process, and at this moment, there is in one side of the wind-up bobbin 1 a yarn reserve of several windings which may be used later in a bobbin creel to connect the yarn end of one bobbin with the yarn end of another bobbin.

Figure 3:
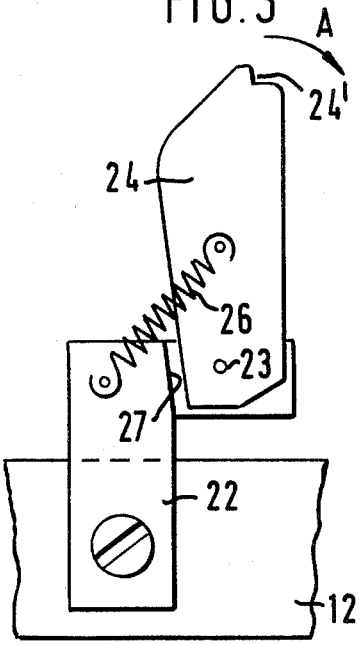
FIG. 3 shows a first modified detail of the device of FIG. 1 in frontal elevation.
Figure 4:
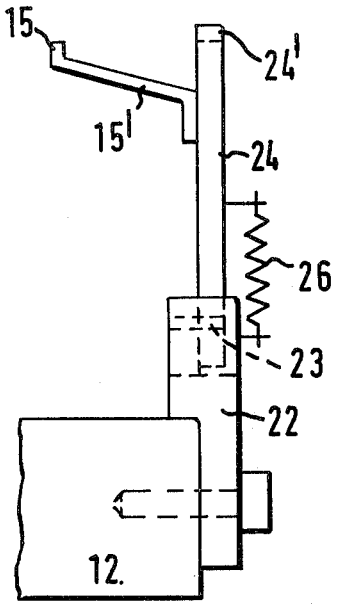
FIG. 4 shows the modification of FIG. 3 in lateral elevation.

In the modification of FIGS. 3 and 4, the stationary thread guiding element 13 is replaced by an angle member 22 fixed on the bobbin support rod 12 by means of screws and by a part 24 with a catching groove 24', which can be swung round a pivot 23. The support 15' with the catching thread-guide 15 is fixed to the pivoted part 24. On part 24, there is fixed one end of a tension spring 26 the other end of which is fixed on the member 22. The spring 26 presses the part 24 against an abutment 27 on the angle member 22 and locates it in the shown operation position. In operating the machine, the part 24, when touched inadvertently by the fingers, temporarily yields away from the operating position in the direction of arrow A whereby the risk of injury is considerably reduced.

Figure 5:
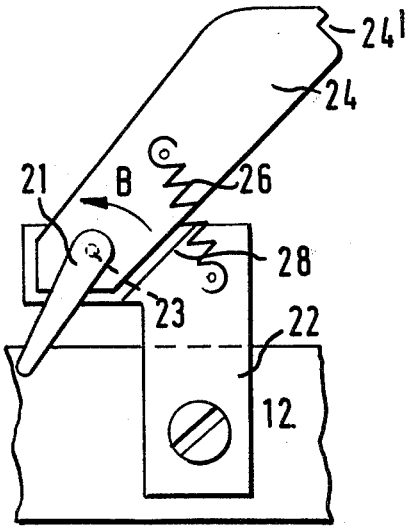
FIG. 5 shows a second modified detail of the device of FIG. 1 in frontal elevation.
Figure 6:
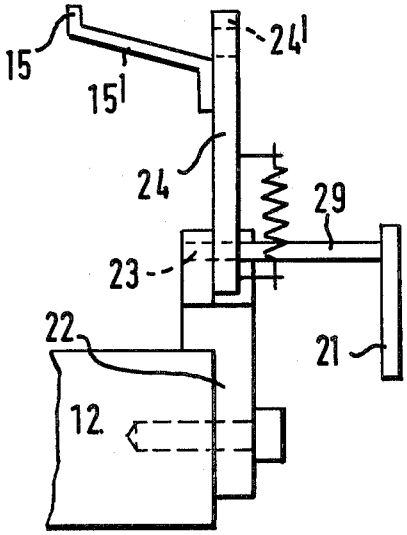
FIG. 6 shows the modification of FIG. 5 in lateral elevation.

In the modification of FIGS. 5 and 6, the angle member 22 fixed on the bobbin support rod 12 extends to the other side as shown, and the part 24, which can be swung about pivot 23, is pressed against an abutment 28 by tension spring 26 and thereby located in the nonoperating position. The part 24 can be temporarily swung up into the operation position by rotation in direction of arrow B of a handle 21 on a rod 29 which is an extension of pivot 23.

We claim:

1. Apparatus for automatically forming a yarn reserve on a wind-up bobbin of a yarn treatment machine comprising means for mounting a bobbin for rotation about a fixed axis, a bobbin mounted in said means, means for rotating said bobbin about said axis, a stationary thread-guide, a slot disc rotatable coaxially with and at one end of said bobbin, said slot disc being operative to pinch and tear off yarn passing through said stationary thread-guide, a first stationary catching thread-guide mounted to catch said yarn as said slot disc rotates and thereupon to guide said yarn while being wound to form a yarn reserve on said bobbin close to said end thereof during rotation of said bobbin and slot disc, a reciprocating thread-guide mounted to traverse said bobbin in moving to-and-fro along a fixed stroke, a movable thread-guide element mounted to reciprocate with said reciprocating thread-guide along said stroke, a second stationary catching thread-guide spaced farther from the wind-up bobbin than the first stationary catching thread-guide, said first and second stationary catching thread-guides and said movable thread-guide element, when approaching one end of said stroke, to pass between said first and second stationary catching thread-guides and to engage said yarn and transfer said yarn from said first catching thread-guide to said second catching thread-guide and, after reversing, to engage said yarn to remove it from said second catching thread-guide, said second catching thread-guide being positioned for said yarn thereupon to enter said reciprocating thread-guide for the yarn to be wound up to fill said bobbin in the wind-up range thereof between said yarn reserve, at one end of said bobbin, and the other end of said bobbin.

2. Apparatus according to claim 1, in which said first stationary catching thread-guide is mounted between the wind-up range of said bobbin and said slot disc and said movable thread-guide element is a plate-shaped part formed with a nose shaped to engage the yarn, and said second stationary catching thread-guide is a plate-shaped part formed with a catching groove.

3. Apparatus according to claim 2, in which said movable thread-guide element is rigidly fixed to said reciprocating thread-guide.

4. Apparatus according to claim 2, in which said first stationary catching thread-guide is fixed to said plate-shaped part constituting said second stationary catching thread-guide.

5. Apparatus according to claim 1, in which said second stationary catching thread-guide comprises a part formed with a catching groove, a support for said part, said part being pivotally mounted on said support, a fixed abutment, and a spring for maintaining said pivoted part in contact with said fixed abutment.

6. Apparatus according to claim 5, in which said abutment is located for said spring to maintain said part in a stationary operating position.

7. Apparatus according to claim 5, in which said abutment is located for said spring to maintain said part in an inoperative position, manual means being provided for moving said part to a stationary operating position for a period required for said yarn to be transferred to and removed from said second stationary catching thread-guide.

8. Apparatus for automatically forming a yarn reserve on a wind-up bobbin of a yarn treatment machine comprising means for mounting a bobbin for rotation about a fixed axis, a bobbin mounted in said means, means for rotating said bobbin about said axis, a stationary thread-guide, a slot disc rotatable coaxially with and at one end of said bobbin, said slot disc being operative to pinch and tear off yarn passing through said stationary thread-guide, a first stationary catching thread-guide mounted to catch said yarn as said slot disc rotates and thereupon to guide said yarn while being wound to form a yarn reserve on said bobbin close to said end thereof during rotation of said bobbin and slot disc, a reciprocating thread-guide mounted to traverse said bobbin in moving to-and-fro along a fixed stroke, a movable thread-guide element mounted to reciprocate with said reciprocating thread-guide along said stroke, a second stationary catching thread-guide, said first and second stationary catching thread-guides and said movable thread-guide element being positioned for said movable thread-guide element, when approaching one end of said stroke, to engage said yarn and transfer said yarn from said first catching thread-guide to said second catching thread-guide and, after reversing, to engage said yarn to remove it from said second catching thread-guide, said second catching thread-guide being positioned for said yarn thereupon to enter said reciprocating thread-guide for the yarn to be wound up to fill said bobbin in the wind-up range thereof between said yarn reserve, at one end of said bobbin, and the other end of said bobbin, said second stationary catching thread-guide comprising a part formed with a catching groove, a support for said part, said part being pivotally mounted on said support, a fixed abutment, and a spring for maintaining said pivoted part in contact with said fixed abutment.

9. Apparatus according to claim 8, in which said abutment is located for said spring to maintain said part in its stationary operating position.

10. Apparatus according to claim 8, in which said abutment is located for said spring to maintain said part in an inoperative position, manual means being provided for moving said part to a stationary operating position for a period required for said yarn to be transferred to and removed from said second stationary catching thread-guide.

* * * * *